United States Patent [19]

Terza

[11] Patent Number: 4,846,472

[45] Date of Patent: Jul. 11, 1989

[54] BASEBALL BATTING TRAINER

[76] Inventor: Thomas J. Terza, 429 36th St., McKeesport, Pa. 15132

[21] Appl. No.: 160,338

[22] Filed: Feb. 25, 1988

[51] Int. Cl.[4] ..... A63B 69/40

[52] U.S. Cl. ..... 273/26 E; 273/58 C

[58] Field of Search ..... 273/26 E, 26 R, 29 A, 273/208, 207, 58 C, 413, 200 R; 272/76, 77, 78, 136, 142; 446/486

[56] References Cited

U.S. PATENT DOCUMENTS

| | | | |
|---|---|---|---|
| 808,528 | 12/1905 | Finney et al. | 272/78 |
| 2,765,170 | 10/1956 | Brown | 273/26 E |
| 2,942,883 | 6/1960 | Moore | 273/26 |
| 3,086,775 | 4/1963 | Albert | 273/26 EA |
| 3,531,115 | 9/1970 | Alexander | 273/58 C |
| 3,637,209 | 1/1972 | Raut | 273/26 E |
| 3,731,925 | 5/1973 | Caldwell | 273/26 E |
| 3,907,287 | 9/1975 | Fox et al. | 273/26 E |
| 3,921,976 | 11/1975 | Lane | 273/26 R |
| 3,944,817 | 7/1960 | Stiller | 273/58 C |
| 4,186,921 | 2/1980 | Fox | 273/26 E |
| 4,555,111 | 11/1985 | Alvarez | 273/26 B |
| 4,577,864 | 3/1986 | Aldrich | 273/58 C |
| 4,609,197 | 9/1986 | Vodin | 273/200 R |
| 4,681,318 | 7/1987 | Lay | 273/26 R |

FOREIGN PATENT DOCUMENTS

| | | | |
|---|---|---|---|
| 210218 | 1/1924 | United Kingdom | 273/200 R |

*Primary Examiner*—Richard C. Pinkham
*Assistant Examiner*—T. Brown
*Attorney, Agent, or Firm*—Carothers & Carothers

[57] ABSTRACT

A baseball batting aid or trainer comprises a hand-held rigid handle having an elongated extension with an outer base portion at its free end, and a flexible, preferably extensible member co-extending with the extension, the extensible member being affixed adjacent one end with respect to the extension and adjacent the opposed end to a baseall or like target object, the tether and extension being arranged to retain the target object in engagement on the base portion of the elongated extension whereby the trainer may be used to hold the target object in a selected position before a batter to facilitate practice by, and training of the batter.

7 Claims, 1 Drawing Sheet

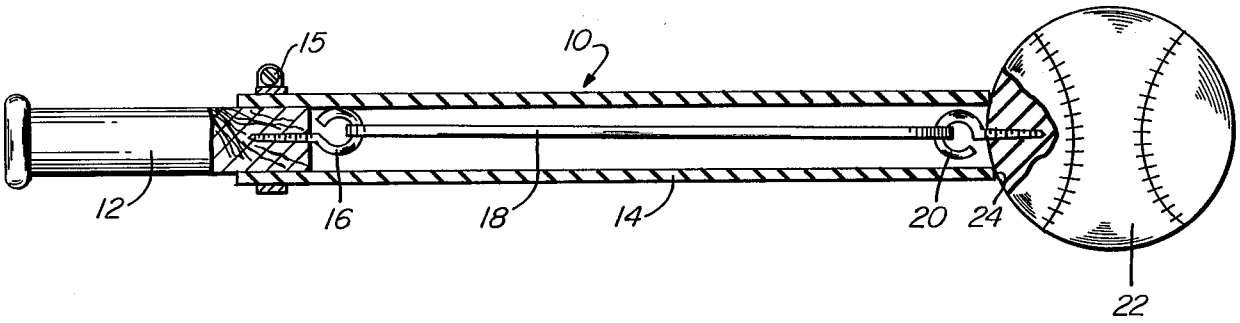
22
24
20
14
10
18
16
15
12

BASEBALL BATTING TRAINER

BACKGROUND OF THE INVENTION

This invention relates generally to improvements in sporting equipment, and more specifically to a batting practice device for use in training and coaching of batting technique in the game of baseball. Numerous prior devices intended for use as practice batting devices have been developed for use in allowing a batter to swing at a relatively stationary ball. For example, various sorts of so-called baseball tees have been proposed for the purpose of supporting a baseball at a selected height above the ground on a base or stand whereby the batter may swing at the stationary ball such as in the child's baseball game known as tee ball. U.S. Pat. No. 4,681,318 discloses one such ball Tee. Other baseball practice devices known from the prior art include tether devices that have a baseball or the like affixed to one end of an elongated flexible tether which has its opposed end affixed to a hand held handle. For example, U.S. Pats. Nos. 3,907,287, 3,731,925, 3,637,209 and 2,942,883 all disclose tethered ball devices.

Also known from the prior art are practice batting devices comprised of a ball or similar target affixed rigidly or flexibly to a hand-held handle whereby the ball may be positioned before a batter in a practice or training endeavor to permit the batter to swing at the target. U.S. Pats. Nos. 3,921,976 and 2,765,170 typify such devices. As to these latter two prior patents, U.S. Pat. No. 3,921,976 discloses a device having an elongated handle and a resilient head member fixedly secured to one end of the handle, whereas U.S. Pat. No. 2,765,170 discloses a ball flexibly affixed to the free end of an elongated coil spring whose opposed end if affixed to a handle. An elongated rigid member extends from the handle within the confines of the coil spring to provide support for a portion of its length.

BRIEF SUMMARY OF THE INVENTION

The present invention contemplates an improved batting practice device generally of the type exemplified by the last two cited prior patents but offering numerous improvements in structure and performance not contemplated by the prior art.

My invention generally comprises an apparatus having a hand-held handle from which there extends an elongated, preferably flexible and tubular extension having an outer open end. An elongated flexible, and preferably resiliently extensible retention member extends within the tubular extension. One end of the elongated retention member is secured at or near the handle whereas the opposed end is secured to a baseball or similar target object. Preferably, the natural or innate length of the elongated retention member is less than the length from its point of retention within the tubular extension to the outer open end of the tubular extension such that the retention member must be stretched in tension beyond the open end of the tubular extension for attachment to the ball or target object. Accordingly, the flexible member exerts a tension force which biases the ball or target object into engagement upon the open end of the tubular extension and retains the same there for ready and easy positioning of the ball before a batter for practice swings.

When the batter swings at and strikes the target, the flexible retention thereof, together with the flexibility of the tubular extension itself, serve to absorb a major part of the shock loading from the blow whereby a trainer or coach, who is holding the handle of the device for practice swings by the batter, may use the device continuously over extended period of time without fatiguing the hand and arm, and with greatly reduced risk of injury.

It is therefore one object of the invention to provide a novel and improved baseball batting practice apparatus.

It is a further object of the invention to provide a baseball batting practice device offering improved ease and safety of use.

A more specific object of the invention is to provide a baseball batting practice device which permits a coach or trainer to readily position a baseball before a batter for practice swings by the batter while at the same time permitting retention of the practice baseball in a flexible manner to minimize transmission of impact and shock loads to the hand and arm of the user.

These and other objects and further advantages of my invention will become more readily apparant upon consideration of the following detailed description and the accompanying drawing, in which the sole figure is a partially sectioned side elevation of one presently preferred embodiment of my novel batting trainer designated generally by the numeral 10 and comprising a handle 12 of wood or similar material which is suitably shaped or formed to be hand-held. For example, handle 12 may generally take the form of a baseball bat handle, although a variety of other handle shapes or forms may also be suitable.

An elongated generally tubular support member or extension 14 is affixed to and extends from handle 12 and terminates in an open end 24 which forms a base for receiving a ball or other target object. Extension 14 preferably is of flexible material such as rubber or reinforced rubber (e.g., a length of suitably constructed garden hose, for example) and is of such mechanical properties as to be readily flexible in lateral bending and self supporting when not subjected to lateral loads. Tubular extension 14 is affixed to handle 12 as by having the handle 12 received within one end thereof in tight friction fit, or in addition by any such suitable anchoring means as a circumferential band clamp 15 encompassing the end of extension 14 which receives handle 12. As an alternative, a plurality of circumferentially distributed screws (not shown) may be driven radially through the same end of tubular extension 14 and into handle 12, or any similar, suitable mechanical retention means may be likewise utilized. A retention device such as a screw eye 16 is threadedly received into the end of handle 12 within tubular extension 14 to provide a retension point where one end of an elongated flexible retention member 18 is secured. A similar screw eye 20 is threadedly engaged within a baseball or similar target member 22 to retain member 18 with respect to the ball 22. Ball 22 may be a regulation wound baseball, or alternatively a rubber core ball as shown, for example.

Any suitable alternative target means for use in baseball batting training and practice may be used in lieu of ball 22, subject to the limitations of use and operation specified below. Elongated retention member 18 may be a length of inextensible wire extending between screw eyes 20 and 16, but preferably is a member which is resiliently extensible in tension, for example a resiliently extensible rubber band member or a plurality of such members, or an elongated coil spring. Further, retention of such a member with respect to ball 22 and handle 12 or tubular extension 14 may be effected in any of a variety of ways. For example, in lieu of screw eye 20, member 18 may be passed entirely through ball 22 and secured therein by attachment to a toggle button on the opposed side of ball 22. Alternative modes of retention in lieu of screw eye 16 also are contemplated, for example, a cross member (not shown) extending transversely of tubular extension 14 and through the opposed side walls thereof may be utilized to provide an anchor for retention of the inner end of member 18.

Retention member 18 is of a length, with respect to the distance between its retention point within tubular extension 14 and its retention point in ball 22 when ball 22 resides in engagement with the open end 24 of tubular member 14, that a tension force exerted by retention member 18 retains ball 22 in engagement on open end 24. The self supporting property of tubular extension 14 thus allows the position of ball 22, residing in biased engagement on open end 24, to be manipulated by direct manipulation of handle 12. A user holding handle 12 thus may position the ball before a practicing batter with tubular member 14 extending at any angle he wishes with respect to himself and the batter. It is thus extremely easy to move the ball within the strike zone for purposes of demonstration and to position the ball for practice swings by the batter. This would not appear to be possible with prior art devices in which the ball is not firmly held by the practice device, but instead dangles from a series of chain-like link connections.

When ball 22 is struck by a practicing batter with a bat, the impact loading separates ball 22 from open end 24 as retention member 18 extends in tension. Shock loading to the hand of the user who is holding handle 12 thus is reduced to a minimum. Should the batter also strike an adjacent portion of tubular member 18, its lateral flexibility under bending loads also will prevent transmission of harmful shock loads to the hand and arm of the user. This advantage is unavailable in prior art devices which have a ball or target more or less rigidly mounted on an inflexible elongated handle member.

From the above description, it will be appreciated that I have invented a novel and improved baseball batting trainer which provides improved ease of use and improved safety for the user through incorporation of a novel structural combination not heretofore envisioned in the art. Of course, I have contemplated various modified and alternative embodiments comprised of alternative structural elements apart from those shown in the accompanying drawing and specifically recited by reference numerals. Some of such alternatives are mentioned hereinabove. The above mentioned and other alternatives surely would also occur to those versed in the art once apprised of my invention. Accordingly, it is my intent that the invention be construed broadly and limited only by the scope of the claims appended hereto.

I claim:

1. A sports training apparatus for facilitating teaching of baseball batting technique comprising:

a handle means adapted to be gripped by the hand of a user;

a hollow elongated flexible, support member having one longitudinal end thereof attached to said handle means;

a target receiving base located at the other end of said elongated support member;

a target means positioned at said base; and an elongated elastic tension means extending within said hollow support member, said tension means having one of its ends retained within said hollow member at a connection point adjacent said handle means and its other end connected to said target means and operable to bias said target means into engagement with said base means.

2. The sports training apparatus claimed in claim 1 wherein said base is said other end of said support member.

3. The sports training apparatus as claimed in claim 2 wherein said tension means extends substantially throughout the entire longitudinal extent of said support member.

4. The sports training apparatus as claimed in claim 3 wherein said tension means is maintained in tension when extending between said connection point and said other end.

5. The sports training apparatus as claimed in claim 4 wherein said elongated support member is a length of garden hose and the said target means is a spherical target of a size approximating the size of a standard baseball or softball.

6. The sports training apparatus as claimed in claim 5 wherein said tension means is a rubber band.

7. The sports training apparatus as claimed in claim 5 wherein said tension means is a coil spring.

* * * * *